US011300918B2

(12) United States Patent
Watanabe et al.

(10) Patent No.: US 11,300,918 B2
(45) Date of Patent: Apr. 12, 2022

(54) CLEANING DEVICE AND IMAGE FORMING APPARATUS

(71) Applicant: KYOCERA Document Solutions Inc., Osaka (JP)

(72) Inventors: Takeshi Watanabe, Osaka (JP); Hiroki Sakane, Osaka (JP); Masato Usui, Osaka (JP); Kenichi Satake, Osaka (JP); Shinobu Ohata, Osaka (JP); Naoto Miyakoshi, Osaka (JP); Shunsuke Yamasaki, Osaka (JP); Yasuhiro Michishita, Osaka (JP); Yusuke Tamekuni, Osaka (JP); Yuzuru Yuasa, Osaka (JP); Hiroatsu Tamai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/037,536

(22) Filed: Sep. 29, 2020

(65) Prior Publication Data

US 2021/0096499 A1 Apr. 1, 2021

(30) Foreign Application Priority Data

Sep. 30, 2019 (JP) ..... JP2019-179172

(51) Int. Cl.
*G03G 21/00* (2006.01)

(52) U.S. Cl.
CPC ..... *G03G 21/0005* (2013.01)

(58) Field of Classification Search
CPC ..... G03G 21/0005; G03G 21/0041; G03G 15/161; G03G 15/2017
USPC ..... 399/71
See application file for complete search history.

(56) References Cited

U.S. PATENT DOCUMENTS 6,038,731 A * 3/2000 Hara ..... B41F 35/00 15/256.51
7,627,263 B2 * 12/2009 Takishita ..... G03G 15/161 399/101
2010/0232849 A1 * 9/2010 Nanataki ..... G03G 15/2025 399/327

FOREIGN PATENT DOCUMENTS

JP 2006-117420 A 5/2006

* cited by examiner

*Primary Examiner* — Arlene Heredia
(74) *Attorney, Agent, or Firm* — Studebaker & Brackett PC

(57) ABSTRACT

A cleaning device includes a cleaning unit and a unit moving mechanism. The cleaning unit brings a web into contact with a conveyance member rotating around an axis and removes foreign matter adhered to the conveyance member. The unit moving mechanism displaces the cleaning unit to a cleaning position where the web is brought into contact with the conveyance member and to a separation position where the web is separated away from the conveyance member. When the unit moving mechanism displaces the cleaning unit from the cleaning position to the separation position, the cleaning unit is displaced in a counter direction opposite to a rotational direction of the conveyance member on a contact face between the conveyance member and the web.

9 Claims, 11 Drawing Sheets

CLEANING DEVICE AND IMAGE FORMING APPARATUS

INCORPORATION BY REFERENCE

This application is based on and claims the benefit of priority from Japanese Patent application No. 2019-179172 filed on Sep. 30, 2019, which is incorporated by reference in its entirety.

TECHNICAL FIELD

The present disclosure relates to a cleaning device and an image forming apparatus.

BACKGROUND

For example, there is conventionally provided a cleaning device which removes sheet powder or the others adhered on a resist roller disposed on a conveyance path along which a sheet is conveyed from a sheet placement part to an image forming part. The cleaning device removes the sheet powder and the others adhered to the resist roller by bringing a cleaning web into pressure-contact with the rotating resist roller by a pressure roller. The cleaning device winds the used portion of the cleaning web after a predetermined number of the sheets is passed and then brings the unused portion of the cleaning web into contact with the outer circumferential face of the resist roller in order to perform a next cleaning operation. After the cleaning operation is completed, the pressure roller (the cleaning web) is separated away from the resist roller.

By the way, at a double-side printing, because the sheet printed on one face is inverted upside down and then conveyed by the conveyance members such as the resist roller, foreign matter such as toner and ink on the sheet, in addition to the sheet powder, may adhere to the outer circumference face of the resist roller. The foreign matter adhered to the resist roller may cause contamination on the next sheets (image contamination occurs), and it is preferable to clean the resist roller by bringing the cleaning web into pressure-contact with the resist roller after a double-side printing is performed a predetermined number of times.

In a case where the cleaning operation is performed in such a way that the cleaning web is brought into contact with the resist roller while rotating the resist roller, like the above cleaning device, the foreign matter is blocked at a contact portion between the resist roller and the cleaning web, and then accumulated mainly on a contact start point between the resist roller and the cleaning web. When the pressure roller is separated away from the resist roller after the cleaning operation is completed, the accumulated foreign matter remains on the surface of the resist roller, resulting in the image contamination even after the cleaning operation.

SUMMARY OF THE INVENTION

In accordance with one aspect of the present disclosure, a cleaning device includes a cleaning unit and a unit moving mechanism. The cleaning unit brings a web into contact with a conveyance member rotating around an axis and removes foreign matter adhered to the conveyance member. The unit moving mechanism displaces the cleaning unit to a cleaning position where the web is brought into contact with the conveyance member and to a separation position where the web is separated away from the conveyance member. When the unit moving mechanism displaces the cleaning unit from the cleaning position to the separation position, the cleaning unit is displaced in a counter direction opposite to a rotational direction of the conveyance member on a contact face between the conveyance member and the web.

In accordance with one aspect of the present disclosure, an image forming apparatus includes a conveyance member rotating around an axis to convey a sheet along a conveyance path, and the cleaning device which cleans the conveyance member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an embodiment of the present disclosure will be described. Arrows "L", "R", "U", "Lo", "Fr" and "Rr" marked in each figure respectively show the left side, the right side, the upper side, the lower side, the front side and the rear side of the image forming apparatus. The terms showing a direction and a position in the specification are used for convenience of the explanation, and do not limit the technical scope of the present disclosure.

Figure 1:
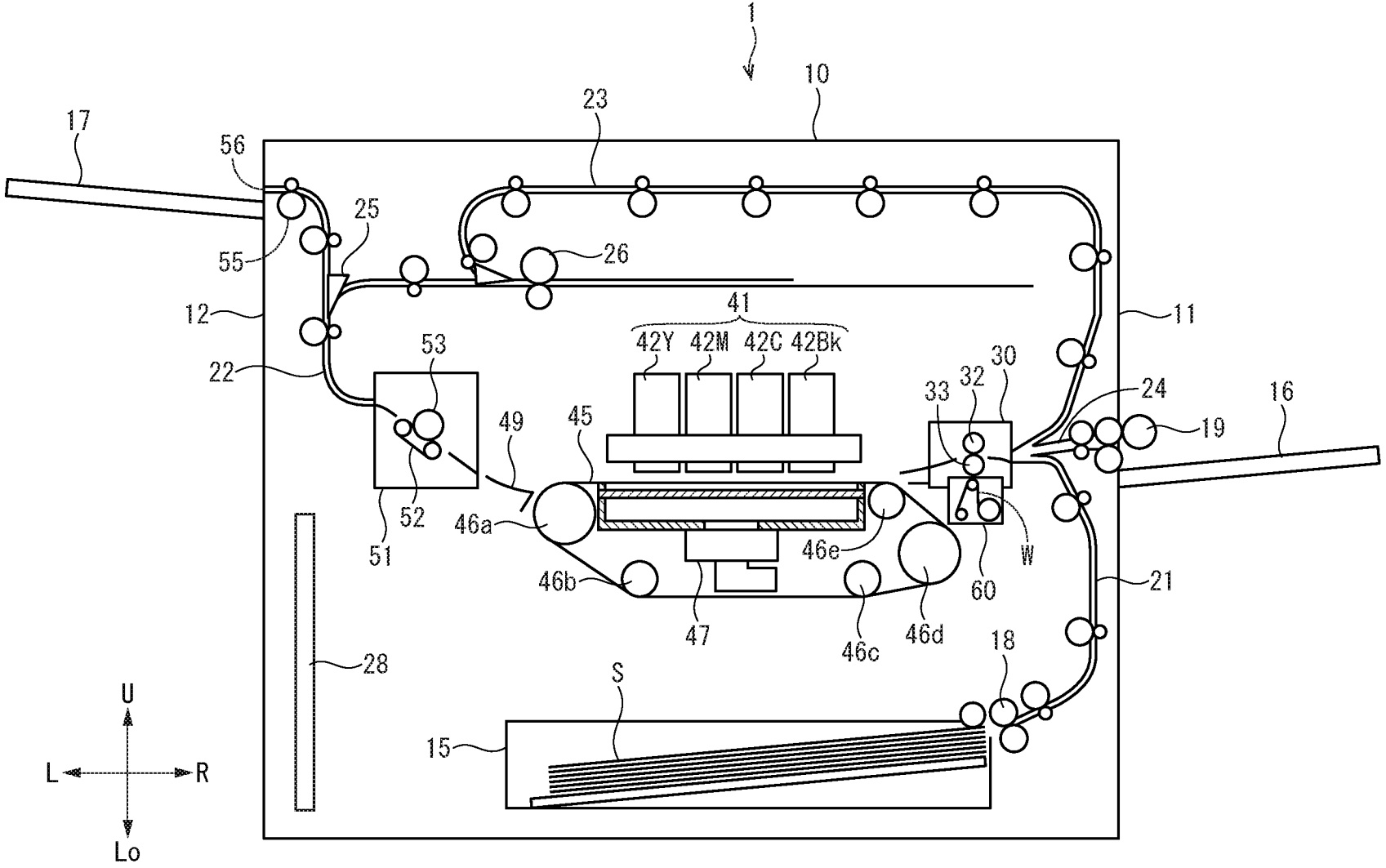
FIG. 1 is a sectional view schematically showing an inner structure of an image forming apparatus according to one embodiment of the present disclosure.

[Outline of image forming apparatus] With reference to FIG. 1, the image forming apparatus 1 will be described. FIG. 1 is a sectional view showing an inner structure of the image forming apparatus 1, when viewed from the front side.

The image forming apparatus 1 is an inkjet type printer which ejects an ink drop to form an image on a sheet S, and performs printing on one face or both faces of the sheet S. The image forming apparatus 1 includes a box-like housing 10 in which various units are stored. In the lower portion of the housing 10, a sheet feeding cassette 15 in which the sheet S is placed is stored, and on the right side face 11 of the housing 10, a manual bypass tray 16 on which the sheet S is placed manually is provided. On the upper portion of the left side face 12 of the housing 10, a discharge tray 17 on which the printed sheet S is stacked is provided.

In the right side portion in the housing 10, a first conveyance path 21 is formed, along which the sheet S is conveyed from the sheet feeding cassette 15 to an image forming part 41 provided in almost the center portion of the housing 10. On an upstream portion of the first conveyance path 21, a sheet feeding part 18 is provided, and on a downstream portion of the first conveyance path 21, a resist roller device 30 is provided. The downstream portion of the first conveyance path 21 is connected to a feeding path 24 extending from the manual bypass tray 16, and a sheet feeding part 19 is provided on the feeding path 24. The sheet feeding part 18 is formed so as to feed the sheet S from the sheet stack stored in the sheet feeding cassette 15, and the sheet feeding part 19 is formed so as to feed the sheet S from the sheet stack placed on the manual bypass tray 16.

The resist roller device 30 includes an upper roller 32 and a lower roller 33 (a conveyance member) coming into contact with the upper roller 32 from the lower side. The resist roller device 30 conveys the sheet S along the first conveyance path 21 in such a way that the upper roller 32 and the lower roller 33 rotate around axes while holding the sheet S between them. On a downstream side of the resist roller device 30, the image forming part 41 and a conveyance belt 45 are provided. Below the resist roller device 30, a cleaning device 60 which cleans the lower roller 33 periodically is provided. Hereinafter, in the specification, when the upper roller 32 and the lower roller 33 are described together, they are called "resist rollers 32, 33".

In the image forming part 41, a plurality of (four, in the present embodiment) line heads 42Bk, 42C, 42M and 42Y through which an ink drop is ejected is provided. The line heads 42Bk, 42C, 42M and 42Y eject the ink drops of black, cyan, magenta and yellow, respectively. The conveyance belt 45 is bridged around a plurality of tension rollers 46*a* to 46*e* set below the image forming part 41. The conveyance belt 45 has a plurality of through holes. In the hollow space of the conveyance belt 45, a suction part 47 which generates negative pressure in the through holes of the conveyance belt 45 at a position facing the image forming part 41 is provided.

The sheet S fed from the resist roller device 30 is sucked on the conveyance belt 45 by the negative pressure generated by the suction part 47. Then, the ink drops are sequentially ejected from the line heads 42Bk, 42C, 42M and 42Y on the sheet S sucked on the conveyance belt 45, and then a full color image is formed on the sheet S by the black, cyan, magenta and yellow inks. After the sheet S is passed below the line heads 42Bk, 42C, 42M and 42Y, the suction of the sheet S on the conveyance belt 45 is released, and the printed sheet S is guided by a discharge guide 49 to a decurl device 51. The decurl device 51 conveys the sheet S while holding the sheet S between a conveyance belt 52 and a correction roller 53, and corrects a curl of the sheet S generated by drying of the ink.

In the left side portion in the housing 10, a second conveyance path 22 is formed, along which the sheet S is conveyed from the decurl device 51 to the discharge tray 17. On a middle of the second conveyance path 22, a branch member 25 is provided, and on a downstream portion of the second conveyance path 22, a discharge part 55 is provided. The branch member 25 switches a destination of the sheet S into the discharge tray 17 and into a third conveyance path 23 described later. The discharge part 55 is formed so as to discharge the printed sheet S on the discharge tray 17 through a discharge port 56 formed on the left side face 12 of the housing 10.

In the upper portion in the housing 10, the third conveyance path 23 is formed, along which the sheet S is conveyed from the branch member 25 on the middle of the second conveyance path 22 to the resist roller device 30 on a downstream side portion of the first conveyance path 21. On a middle of the third conveyance path 23, a sheet inversion part 26 is provided, on which the sheet S is inverted upside down. The sheet S conveyed to the third conveyance path 23 is switched back on the sheet inversion part 26, is inverted upside down, and then is conveyed to the resist roller device 30. Then, the sheet S whose back face faces upward is conveyed to the image forming part 41 from the resist roller device 30.

The image forming apparatus 1 (the inside of the housing 10) is provided with a controller 28 which suitably controls various devices to be controlled, such as the resist roller device 30, the image forming part 41 and the cleaning device 60. The controller 28 includes a processer which executes various arithmetic processing according to program and parameter stored in a memory. The controller 28 may be established by a logic circuit (hardware) formed on an integrated circuit, in place of the processer executing the program.

[Image forming operation] With reference to FIG. 1, an image forming operation of the image forming apparatus 1 will be described. The controller 28 suitably controls the various devices to be controlled, to perform the image forming operations as follows.

The sheet feeding part 18 or 19 feeds the sheet S from the sheet feeding cassette 15 or the manual bypass tray 16 to the first conveyance path 21 or the feeding path 24. The resist roller device 30 (the conveyance member) blocks the sheet S temporarily before printing (one-side printing), corrects a skew of the sheet, and then feeds (conveys) the sheet S on the conveyance belt 45 in accordance with an ejecting timing of the ink drops from the line heads 42Bk, 42C, 42M and 42Y. The image forming part 41 (the line heads 42Bk, 42C, 42M and 42Y) ejects the ink drops on the sheet S on the conveyance belt 45 and forms an image on the sheet S (prints). The decurl device 51 correct a curl of the sheet S.

In the one-side printing, the branch member 25 opens the second conveyance path 22 and closes the third conveyance path 23. The sheet S printed on one face is conveyed along the second conveyance path 22 and then discharged through the discharge port 56 on the discharge tray 17.

In the double-side printing, the branch member 25 closes the second conveyance path 22 and opens the third conveyance path 23. The sheet S printed on one face is conveyed along the third conveyance path 23, is inverted upside down on the sheet inversion part 26, and then is conveyed toward the resist roller device 30 again. The resist roller device 30 (the conveyance member) corrects a skew of the sheet S printed on one face and inverted upside down (for the double-side printing), and then feeds (conveys) it on the conveyance belt 45 in accordance with the ejecting timing of the ink drops. The image forming part 41 ejects the ink drops on the back face of the sheet S, and forms an image on the sheet S (prints). The sheet S printed on the both faces is corrected a skew by the decurl device 51, is conveyed along the second conveyance path 22 and then is discharged through the discharge port 56 on the discharge tray 17.

By the way, at the double-side printing, because the sheet S whose printed face (the front face) faces downward is conveyed to the resist roller device 30, the ink (pigment or the like) adhered to the front face of the sheet S may adhere to the conveyance face 34 (the outer circumferential face) of the lower roller 33. Then, the ink adhered to the lower roller 33 may contaminate the next sheet S (its lower face) regardless of the one-side printing and the double-side printing. Alternatively, the ink adhered to the lower roller 33 may be transferred to the upper roller 32, and both the faces of the next sheet S may be contaminated by the pair of upper and lower resist rollers 32 and 33. Alternatively, sheet powder may generate by friction between the resist rollers 32 and 33 and the sheet S, and then adhere to the resist rollers 32 and 33. This may cause conveyance failure of the sheet S.

Then, the image forming apparatus 1 according to the embodiment is provided with the cleaning device 60 which brings a part of a belt-shaped web W into contact with the lower roller 33 (the conveyance member) rotating around the axis and removes the foreign matter D (such as the ink and the sheet powder) adhered to the lower roller 33 at the double-side printing of the sheet S.

Figure 2:
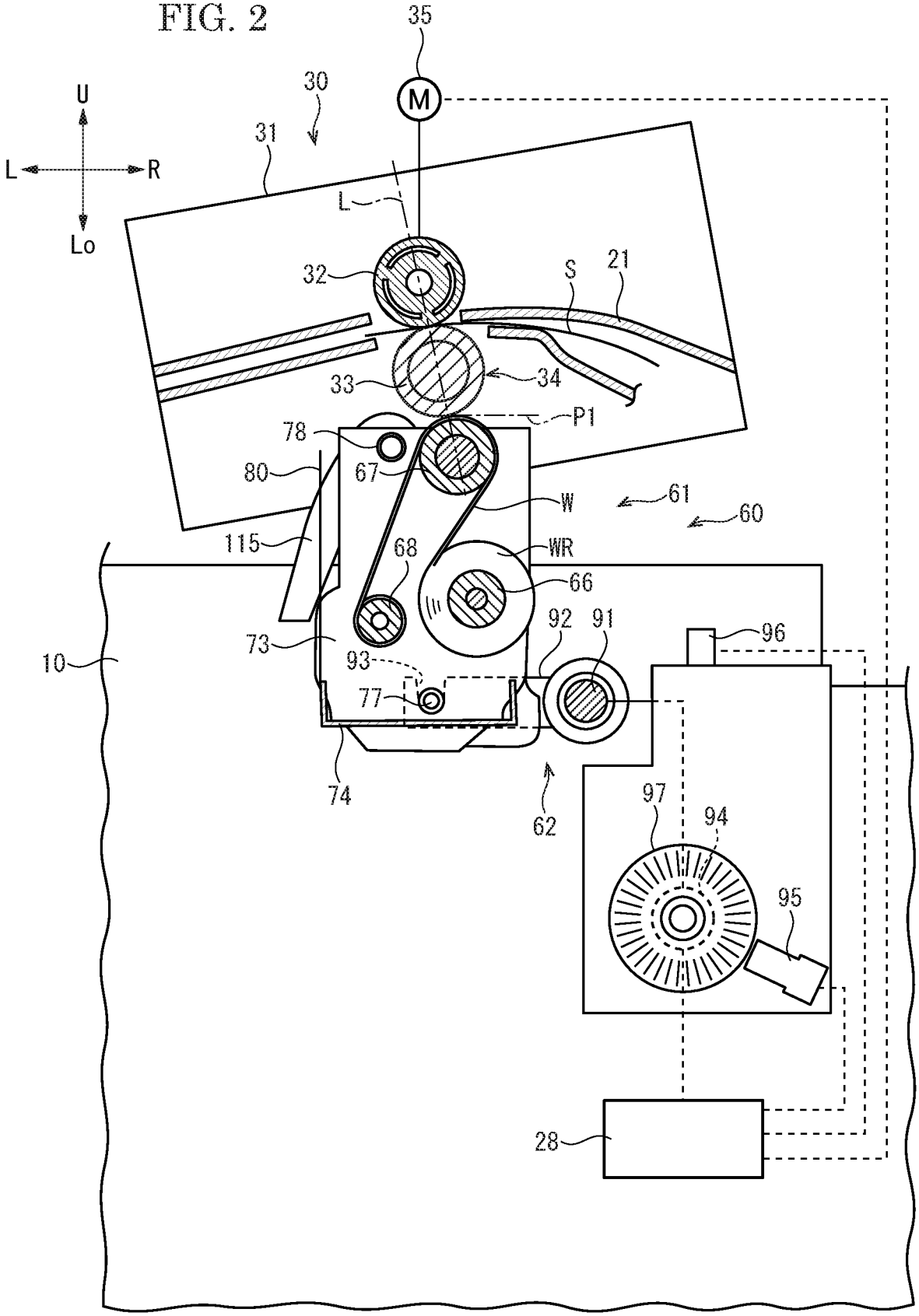
FIG. 2 is a sectional view showing a resist roller device and a cleaning device of the image forming apparatus according to the embodiment of the present disclosure.
Figure 3:
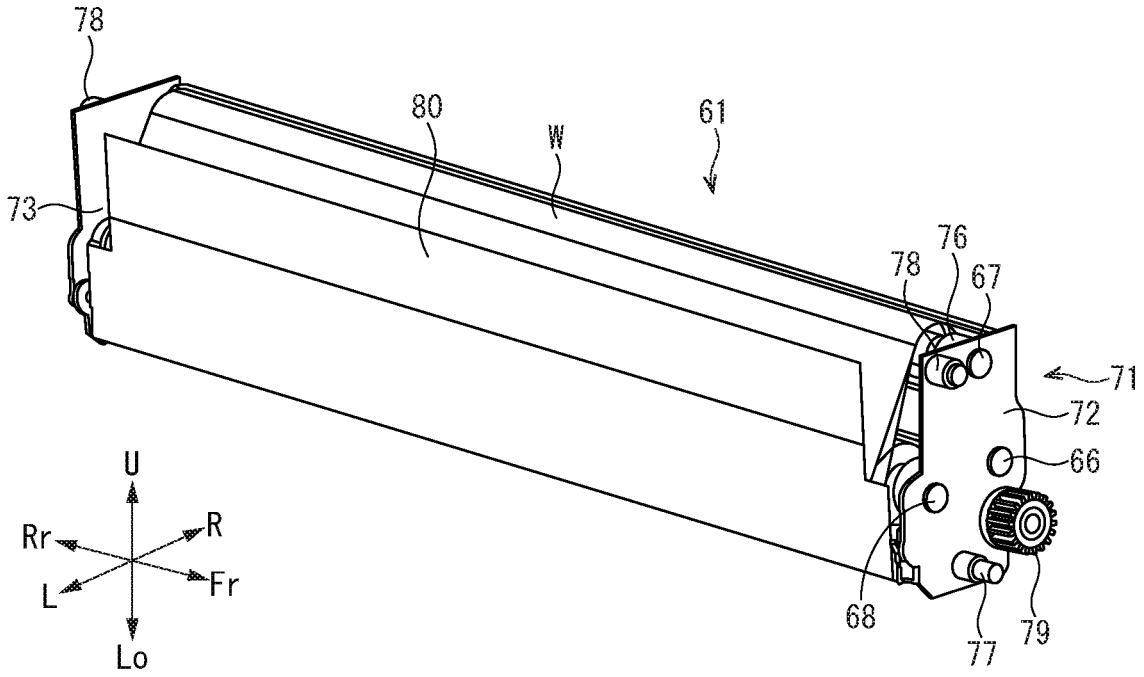
FIG. 3 is a perspective view showing a cleaning unit of the cleaning device according to the embodiment of the present disclosure, viewed from the left side.
Figure 4:
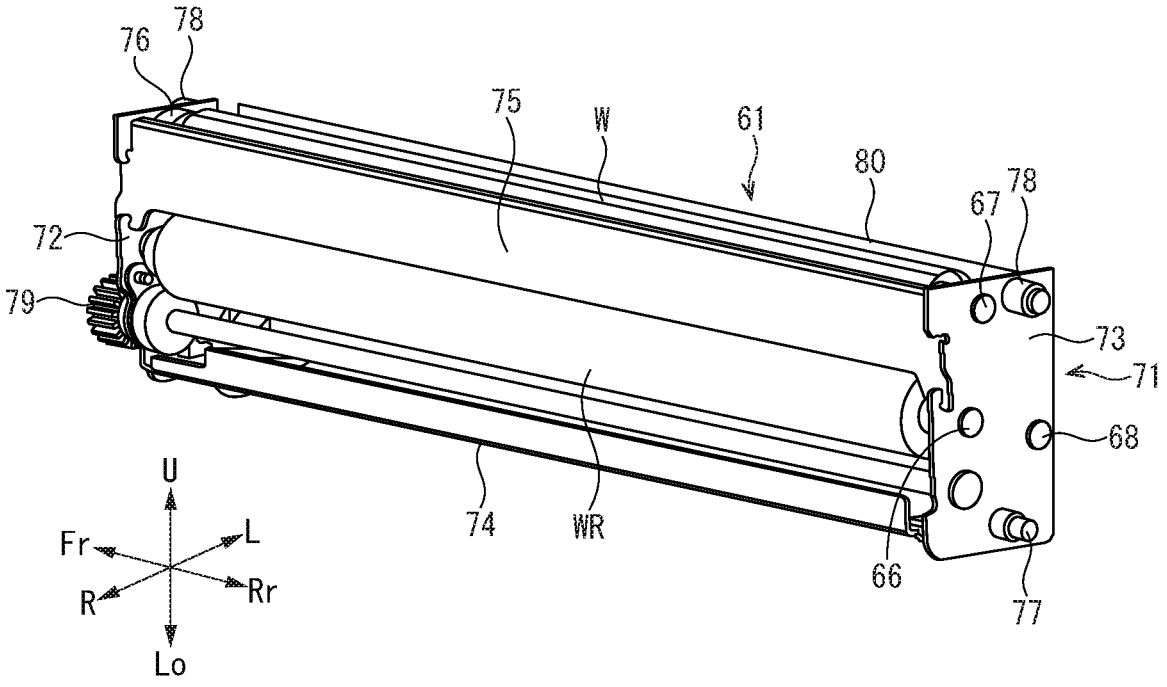
FIG. 4 is a perspective view showing the cleaning unit of the cleaning device according to the embodiment of the present disclosure, viewed from the right side.
Figure 5:
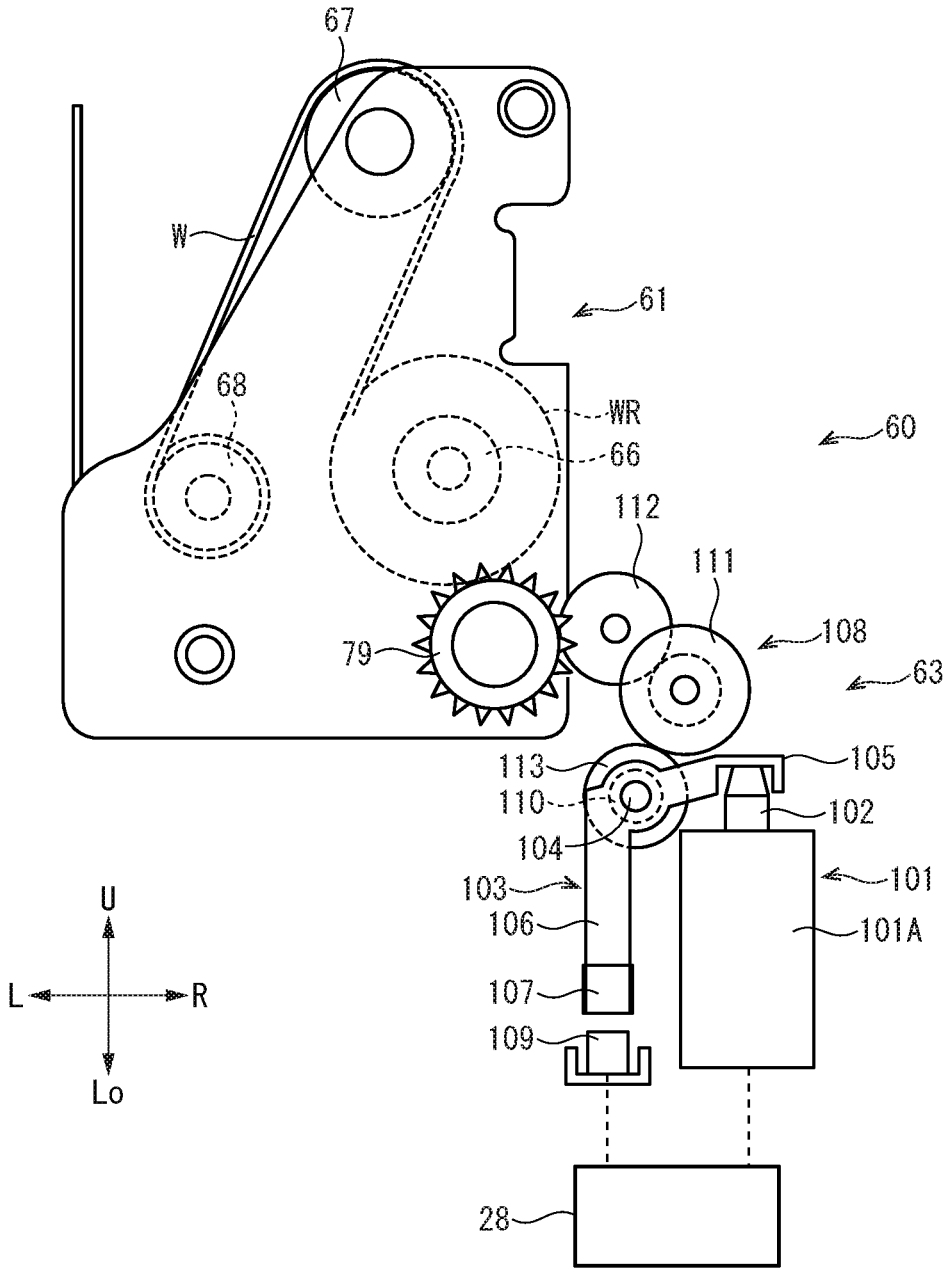
FIG. 5 is a sectional view showing the cleaning unit and a web driving mechanism of the cleaning device according to the embodiment of the present disclosure.
Figure 6:
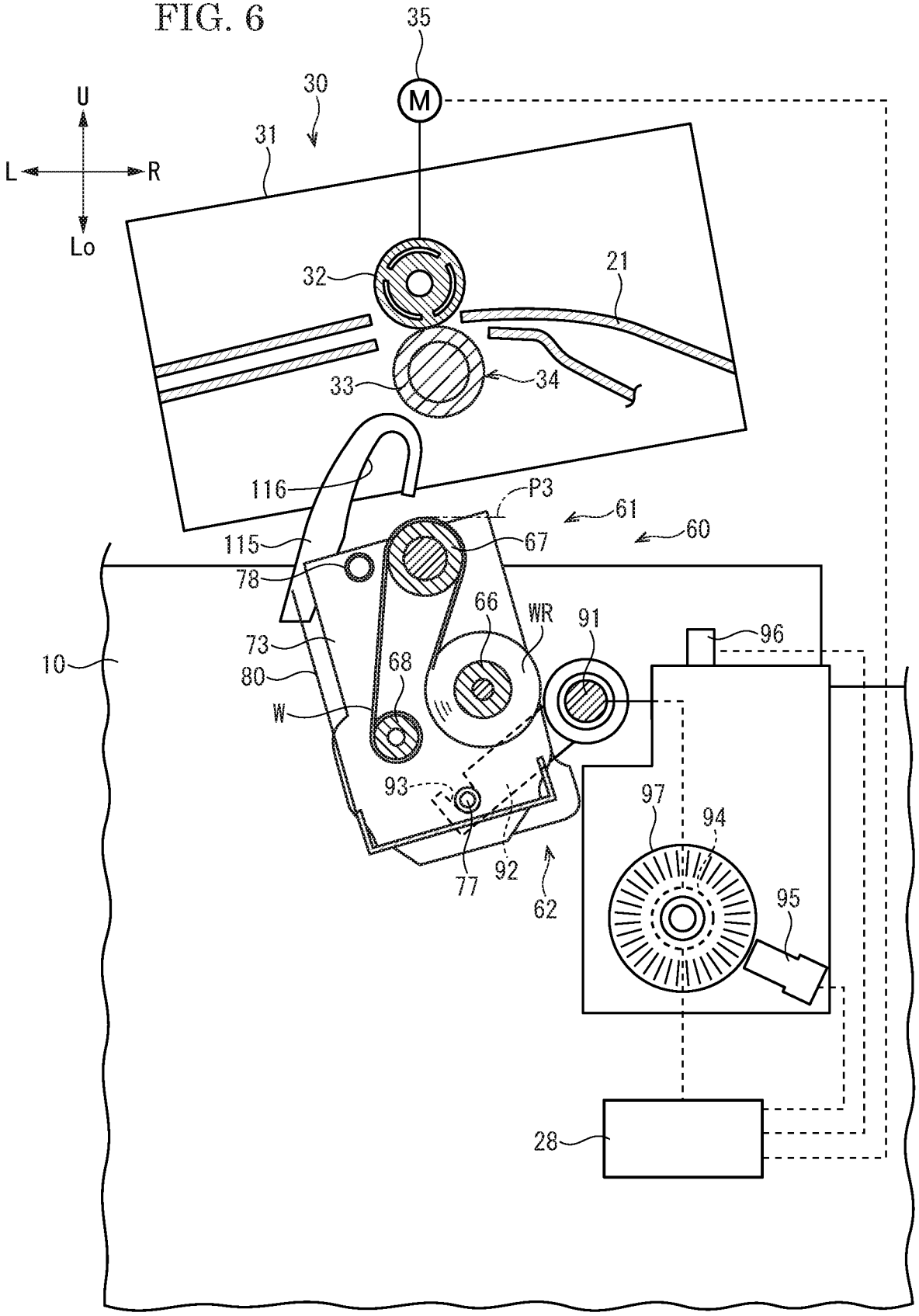
FIG. 6 is a sectional view showing the resist roller device and the cleaning device in a state where the cleaning unit is disposed in an attachment and detachment position, in the image forming apparatus according to the embodiment of the present disclosure.
Figure 7:
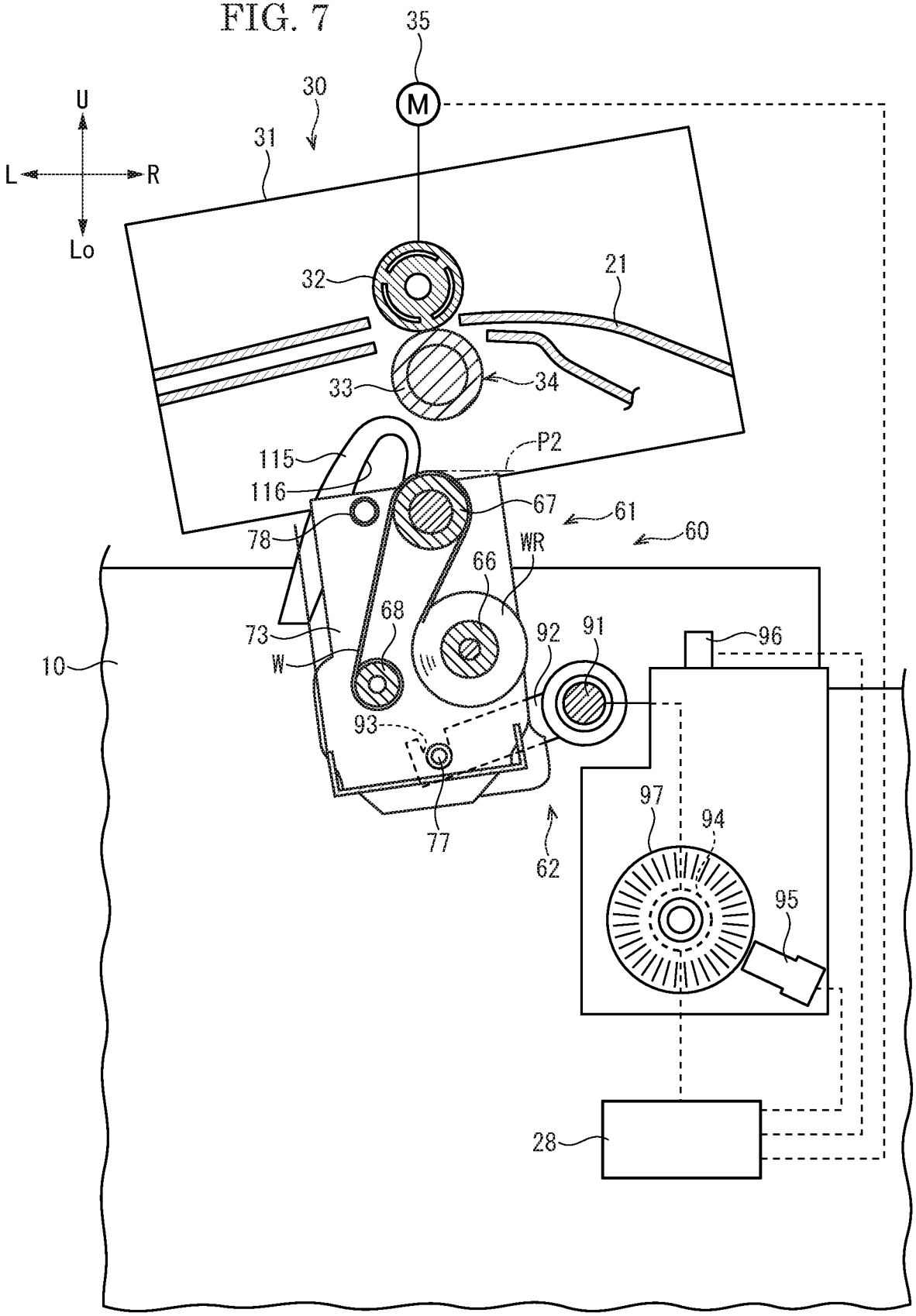
FIG. 7 is a sectional view showing the resist roller device and the cleaning device in a state where the cleaning unit is disposed in a separation position, in the image forming apparatus according to the embodiment of the present disclosure.

Next, with reference to FIG. 2 to FIG. 7, the resist roller device 30 and the cleaning device 60 will be described. FIG. 2 is a sectional view showing the resist roller device 30 and the cleaning device 60, when viewed from the front side. FIG. 3 is a perspective view showing a cleaning unit 61, when viewed from the left side. FIG. 4 is a perspective view showing the cleaning unit 61, when viewed from the right side. FIG. 5 is a sectional view showing the cleaning unit 61 and a web driving mechanism 63, when viewed from the front side. FIG. 6 is a sectional view showing the cleaning unit 61 disposed in an attachment and detachment position P3, when viewed from the front side. FIG. 7 is a sectional view showing the cleaning unit 61 disposed in a separation position P2, when viewed from the front side.

[Resist roller device] As shown in FIG. 2, the resist roller device 30 includes a resist housing 31, the upper roller 32 and the lower roller 33 (the conveyance member). Inside the resist housing 31, the conveyance path for the sheet S (a part of the first conveyance path 21) is formed. The pair of upper and lower resist rollers 32 and 33 is disposed inside the resist housing 31, and supported by the side walls of the resist housing 31 in a rotatable manner. The pair of upper and lower resist rollers 32 and 33 is connected to a resist motor 35 via a driving force transmission mechanism (not shown).

The upper roller 32 is a metallic roller, for example. The lower resist roller 33 has a synthetic resin layer formed around an outer circumferential face of a metallic raw pipe and a PFA (tetrafluoroethylene/perfluoroalkylvinyl ether copolymer) tube covering the synthetic resin layer, for example. A line L coupling a rotational center of the upper roller 32 and a rotational center of the lower roller 33 is inclined with respect to the vertical direction at an acute angle (for example, 10 degrees). That is, the lower roller 33 is disposed at a position slightly displaced from the upper roller 32 on an upstream side in the conveyance direction of the sheet S (on the right side). The pair of resist rollers 32 and 33 is driven by the resist motor 35 to be rotated while holding the sheet S between the resist rollers 32 and 33, and conveys the sheet S to the image forming part 41 (refer to FIG. 1).

[Cleaning device] As shown in FIG. 2, the cleaning device 60 is disposed below the resist roller device 30. The cleaning device 60 includes the cleaning unit 61, a unit moving mechanism 62 and the web driving mechanism 63 (refer to FIG. 5). The cleaning unit 61 is attachable to and detachable from the housing 10 (replaceable). The unit moving mechanism 62 and the web driving mechanism 63 are provided in the housing 10 non-detachably. When the cleaning unit 61 is attached to the housing 10, it is coupled with the unit moving mechanism 62 and the web driving mechanism 63.

<Cleaning unit> As shown in FIG. 2 to FIG. 4, the cleaning unit 61 includes a delivery roller 66 (a delivery part), a pressure roller 67 (a pressing part) and a winding roller 68 (a winding part).

The delivery roller 66, the pressure roller 67 and the winding roller 68 are formed to be long along the lower roller 33, and supported by a cleaning frame 71 whose upper face is opened. As shown in FIG. 3 and FIG. 4, the cleaning frame 71 contains a pair of support frames 72 and 73 facing each other in the front-and-rear direction and supporting the rollers 66, 67 and 68 in a rotatable manner, a lower frame 74 coupling the lower portions of the support frames 72 and 73 each other, and a side frame 75 coupling the right side portions of the support frames 72 and 73 each other. The support frames 72 and 73 are coupled with each other by the lower frame 74 and the side frame 75, and then a rigidity of the cleaning frame 71 is secured.

The lower frame 74 forms the bottom wall of the cleaning frame 71, and functions as a receiver into which the foreign matter D fallen from the web W and the others is received (refer to FIG. 2). The side frame 75 covers the upper half portion of the right side face of the cleaning frame 71 while exposing the lower half portion of the right side face of the cleaning frame 71 (refer to FIG. 4). By viewing a web roll WR through the exposed opening of the right side face, the cleaning unit 61 with the web roll WR having a small remaining amount is prevented from being incorrectly attached to the housing 10. To the lower frame 74, a sheet member 80 (refer to FIG. 2 and FIG. 3) is mounted so as to cover the left side face of the cleaning frame 71 and to prevent the foreign matter D from being scattered to the conveyance belt 45 (refer to FIG. 1).

As shown in FIG. 3 and FIG. 4, on the lower portions of the outer faces of the support frames 72 and 73, support pins 77 coupled with the unit moving mechanism 62 are protruded. On the left upper portions of the outer faces of the support frames 72 and 73, guide rollers 78 which guide the displacement of the cleaning unit 61 relative to the housing 10 are protruded. In the right lower portion of the front support frame 72, an input gear 79 coupled with the web driving mechanism 63 is supported. The input gear 79 is coupled with the winding roller 68 via a driving force transmission mechanism (not shown) set in the cleaning frame 71

(Delivery roller) As shown in FIG. 2 to FIG. 4, the delivery roller 66 is supported between the right lower portions of the support frames 72 and 73 in a rotatable manner. Around the outer circumferential face of the delivery roller 66, a long belt-shaped web W (unused) is wound.

The delivery roller 66 rotates around an axis to deliver the wound unused web W. The web W is wound around the outer circumferential face of the delivery roller 66 a plurality of times to form the web roll WR. The web W delivered from the delivery roller 66 (the web roll WR) is wound around the outer circumferential face of the pressure roller 67, and the tip end of the web W is fixed to the outer circumferential face of the winding roller 68. The web W is made of fabric material such as nonwoven fabric.

(Pressure roller) The pressure roller 67 is supported between the upper portions (above the delivery roller 66) of the support frames 72 and 73 in a rotatable manner. The outer circumferential face of the pressure roller 67 is made of elastic material such as sponge. The pressure roller 67 is exposed through the opened upper face of the cleaning frame 71, and brings a part of the web W delivered from the delivery roller 66 into pressure-contact with the lower roller 33. When the pressure roller 67 is pressed on the lower roller 33, the outer circumferential face of the pressure roller 67 is partially deformed to bring the web W into surface-contact with the conveyance face 34 of the lower roller 33 (refer to FIG. 8).

(Winding roller) The winding roller 68 is supported between the left lower portions (below the delivery roller 66) of the support frames 72 and 73 in a rotatable manner. The web W delivered from the delivery roller 66 is wound around the pressure roller 67, is folded back and then extends to the winding roller 68. The winding roller 68 winds the used portion of the web W after the web W is brought into contact with the lower roller 33.

As described later in detail, in the cleaning device 60, the pressure roller 67 brings the web W into pressure-contact with the rotating lower roller 33 to clean the conveyance face 34 of the lower roller 33. Additionally, in the cleaning device 60, the winding roller 68 winds (collects) the used portion of the web W intermittently, and the unused portion of the web W is then brought into pressure-contact with the conveyance face 34 of the lower roller 33 by the pressure roller 67. Then, a cleaning performance for the lower roller 33 is kept constant. Additionally, the web W is wound along one direction, and in order to prevent inverted winding and loosening of the web W, the delivery roller 66 is provided with a braking mechanism (not shown), and the winding roller 68 is provided with a one-way clutch (not shown).

When the sheet S is jammed between the resist rollers 32 and 33 (a sheet jamming occurs), it is necessary to pull the sheet S out from between the resist rollers 32 and 33. When the sheet S is pulled out, a rotational force is transmitted from the lower roller 33 to the pressure roller 67. The shaft of the pressure roller 67 is provided with a torque limiter 76 (refer to FIG. 3 and FIG. 4). Then, if an excessive rotational force is transmitted from the lower roller 33 to the pressure roller 67, the torque limiter 76 rocks the pressure roller 67. This prevents the web W from being delivered from the delivery roller 66.

<Unit moving mechanism 62> As shown in FIG. 2, the unit moving mechanism 62 includes a support shaft 91, a pair of front and rear rocking arm 92 (the rear rocking arm is only shown), a cleaning motor 94 and a pair of front and rear guide parts 115 (the rear side guide part is only shown).

The support shaft 91 is disposed on a right side of the cleaning unit 61, and supported by the housing 10 in a rotatable manner. The pair of front and rear rocking arms 92 is fixed to the support shaft 91. The cleaning motor 94 is coupled with the support shaft 91 via a driving force transmission mechanism (not shown). The cleaning motor 94 is electrically connected to the controller 28. In the tip end portion of the rocking arm 92, a long-hole shaped hook 93 is cut out. To the hook 93, the support pin 77 of the cleaning unit 61 is fitted (engaged) such that the cleaning unit 61 is supported by the pair of rocking arms 92 in a relatively rotatable manner.

The driving force of the cleaning motor 94 is transmitted to the pair of support shafts 91, and the rocking arms 92 are rocked in the upper-and-lower direction around the support shafts 91. Specifically, the unit moving mechanism 62 (the cleaning motor 94) displaces (lifts and lowers) the cleaning unit 61 to a cleaning position P1, a separation position P2, and an attachment and detachment position P3. The cleaning position P1 is a position for bringing the web W into contact with the lower roller 33 (refer to FIG. 2). The separation position P2 is a position separated below the cleaning position P1 and for separating the web W from the lower roller 33 (refer to FIG. 7). The attachment and detachment position P3 is a position separated below the separation position P2 and for attaching and detaching the cleaning unit 61 to and from the housing 10 (refer to FIG. 6).

As shown in FIG. 6, the pair of front and rear guide parts 115 is disposed on a right side of the cleaning unit 61, and guides the cleaning unit 61 between the cleaning position P1 and the attachment and detachment position P3. Each guide part 115 is formed with a guide face 116 coming into contact with the guide roller 78 of the cleaning unit 61. Each guide face 116 is curved (or bent) in such a way as to protrude leftward from the left lower side to the right upper side and then curve back in an almost U-shape near the lower roller 33. In other words, each guide face 116 extends from the left lower side to the right upper side so as to be close to the lower roller 33.

As shown in FIG. 2, the unit moving mechanism 62 includes a first and a second sensors 95 and 96 to detect a position of the cleaning unit 61. The first and the second sensors 95 and 96 are electrically connected to the controller 28.

The first sensor 95 outputs a pulse signal in response to a rotation of a pulse plate 97 fixed to the output shaft of the cleaning motor 94 to the controller 28. The controller 28 calculates a rotational amount of the cleaning motor 94 based on the pulse signal output from the first sensor 95. Based on the attachment and detachment position P3 of the cleaning unit 61, a position of the cleaning unit 61 is determined from the rotational amount of the cleaning motor 94. The second sensor 96 outputs a detection signal showing a detection of the cleaning unit 61 positioned in the cleaning position P1. Based on the detection signal output from the second sensor 96, the controller 28 determines that the cleaning unit 61 is positioned in the cleaning position P1. The controller 28 adjusts a moving amount (a lifting and lowering amount) of the cleaning unit 61 while feedback controlling the cleaning motor 94. The first sensor 95 only needs to detect the rotational amount of the cleaning motor 94, and the second sensor 96 only needs to detect the cleaning unit 61 positioned in the cleaning position P1. The first and second sensors 95 and 96 may be formed by a photo interrupter or a photo reflector.

<Web driving mechanism 63> As shown in FIG. 5, the web driving mechanism 63 includes a web solenoid 101, a turning lever 103 and a rotation transmission mechanism 108.

(Web solenoid) The web solenoid 101 has a plunger 102 protruding and retracting relative to a cylindrical case 101A. The web solenoid 101 is electrically connected to the controller 28.

(Turning lever) The turning lever 103 is supported by the housing 10 via a turning shaft 104 in a turnable manner on a left side of the web solenoid 101. The turning lever 103 is formed into an inverted L-shape by a side lever 105 extending sideward from the turning shaft 104 and a lower lever 106 extending downward from the turning shaft 104. With the tip end portion of the side lever 105, the tip end of the plunger 102 is coupled, and in the lower portion of the lower lever 106, a detection piece 107 is provided. By protruding and retracting the plunger 102 of the web solenoid 101, the turning lever 103 is reciprocated around the turning shaft 104. That is, the turning lever 103 inverts a protruding and retracting movement of the plunger 102 into a reciprocating turning movement.

Below the lower lever 106, a third sensor 109 to detect the detection piece 107 is provided. The third sensor 109 outputs a detection signal every time when it detects the detection piece 107. The third sensor 109 only needs to detect the detection piece 107, and may be formed by a photo interrupter or a photo reflector.

(Rotation transmission mechanism) The rotation transmission mechanism 108 includes a one-way clutch 110, an output gear 113 and a plurality of transmission gears 111 and 112.

The one-way clutch 110 is provided between the turning lever 103 and the turning shaft 104. The one-way clutch 110 transmits a rotational force to the turning shaft 104 when the turning lever 103 is turned in one direction, and does not transmit the rotational force to the turning shaft 104 when the turning lever 103 is turned in the other direction. In detail, when the plunger 102 protruding from the case 101A is retracted, the turning shaft 104 is turned together with the turning lever 103 in one direction (the clockwise direction). When the plunger 102 retracted in the case 101A is protruded, the turning lever 103 is turned in the other direction (the counterclockwise direction) while the turning shaft 104 is not turned. The one-way clutch 110 may be configured to turn the turning shaft 104 when the plunger 102 is protruded and not to turn the turning shaft 104 when the plunger 102 is retracted.

The output gear 113 is provided in the end portion of the turning shaft 104, and turned together with the turning shaft 104. The plurality of transmission gears 111 and 112 connects the output gear 113 to the input gear 79. The rotational force of the output gear 113 (the turning shaft 104) rotates the winding roller 68 via the plurality of transmission gears 111 and 112 and the input gear 79.

Figure 8:
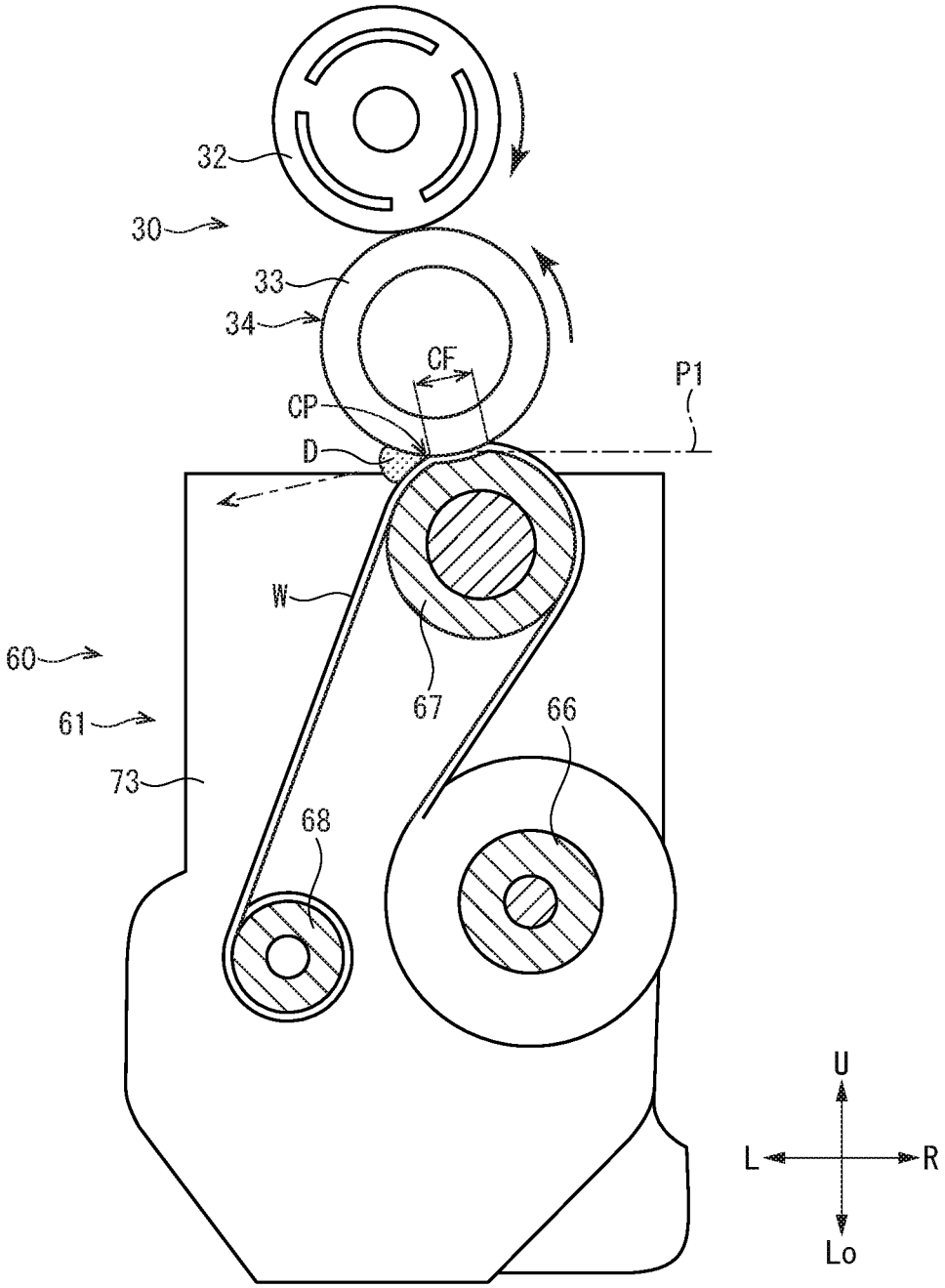
FIG. 8 is a sectional view explaining a cleaning operation of the cleaning device according to the embodiment of the present disclosure.
Figure 9:
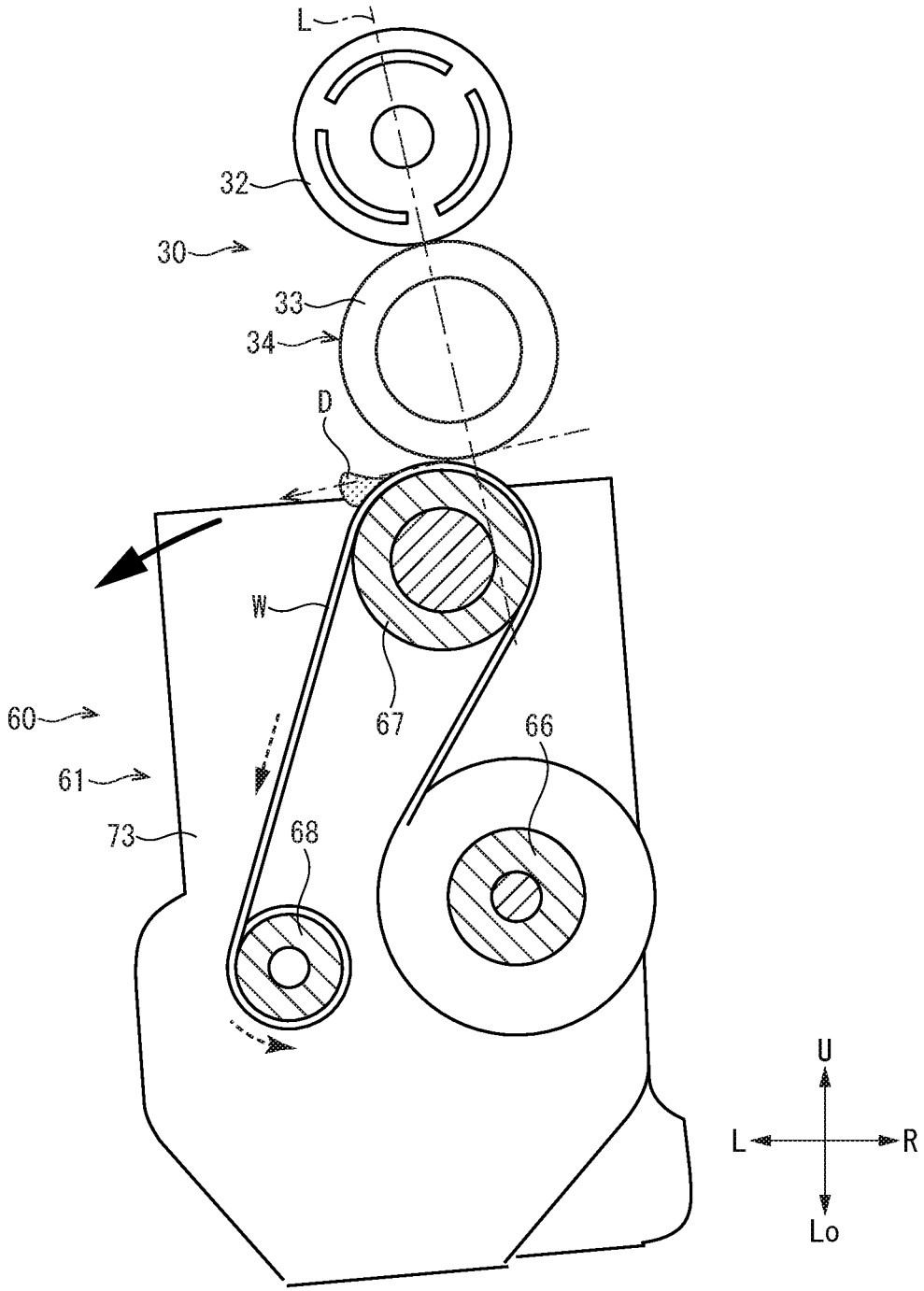
FIG. 9 is a sectional view explaining a separation operation of the cleaning unit of the cleaning device according to the embodiment of the present disclosure.

[Operation of cleaning device] Next, with reference to FIG. 2 and FIG. 6 to FIG. 9, an operation of the cleaning device 60 will be described. FIG. 8 is a sectional view showing the cleaning device 60 in a cleaning operation, when viewed from the front side. FIG. 9 is a sectional view showing the cleaning unit 61 in a separation operation, viewed from the front side.

As shown in FIG. 6, when the cleaning unit 61 is attached to the housing 10, it is disposed in the attachment and detachment position P3. In the state, the hook 93 of the rocking arm 92 faces downward and is engaged with the support pin 77 of the cleaning unit 61. The guide roller 78 of the cleaning unit 61 is separated away from the guide face 116 of the guide part 115. Additionally, in the state, the cleaning unit 61 is coupled with the unit moving mechanism 62 and the web driving mechanism 63.

<From attachment and detachment position to separation position> Next, as shown in FIG. 7, when the cleaning motor 94 is driven according to a driving command output from the controller 28, the rocking arm 92 fixed to the support shaft 91 is turned upward. When the support pin 77 engaged with the hook 93 of the rocking arm 92 is pushed upward, the cleaning unit 61 is displaced upward (to the separation position P2) from the attachment and detachment position P3 while the guide roller 78 rolling along the guide face 116 of the guide part 115. At this time, because the support pin 77 is supported by the hook 93 in a relatively rotatable manner, the cleaning unit 61 is smoothly pushed up depending on the turning of the rocking arm 92.

When the rocking arm 92 is further turned upward, the cleaning unit 61 is disposed in the separation position P2 (refer to FIG. 7). At a non-cleaning operation of the lower roller 33, the cleaning unit 61 is kept in the separation position P2.

<Cleaning operation> The controller 28 controls the cleaning device 60 so as to clean the lower roller 33 periodically (after printing a predetermined number of sheets, after elapsing a predetermined time, for example). Alternatively, a user may operate a touch panel of the image forming apparatus 1 to instruct the cleaning operation of the lower roller 33.

As shown in FIG. 2, when the cleaning motor 94 is driven according to a cleaning command output from the controller 28, the rocking arm 92 is further turned upward. The cleaning unit 61 begins to be displaced from the separation position P2 to the cleaning position P1, and the guide roller 78 of the cleaning unit 61 begins to roll upward along the guide face 116. Because the guide face 116 curves from the left lower side to the right upper side, the cleaning unit 61 is displaced upward along an approximately circular path. The web W wound around the pressure roller 67 begins to come into contact with the lower left side conveyance face 34 of the lower roller 33. After the web W begins to come into contact with the lower roller 33, when the rocking arm 92 is further turned, the cleaning unit 61 is displaced from the left side to the right side while bringing the web W into contact with the lower roller 33. That is, when the unit moving mechanism displaces the cleaning unit 61 from the separation position P1 to the cleaning position P3, it displaces the cleaning unit 61 in a rotation direction of the lower roller 33 on a contact face CF (refer to FIG. 8) between the lower roller 33 and the web W.

In a state where the cleaning unit 61 is displaced to the cleaning position P1, the pressure roller 67 (the pressing part) brings a part of the web W delivered from the delivery roller 66 into pressure-contact with the lower roller 33. The pressure roller 67 is arranged on the line L passing the axial centers of the resist rollers 32 and 33.

As shown in FIG. 2 and FIG. 8, when the resist motor 35 is driven according to a driving command output from the controller 28, the resist rollers 32 and 33 are rotated around the axes. When the lower roller 33 is rotated while the pressure roller 67 bringing the unused web W into pressure-contact with the lower roller 33, the conveyance face 34 of the lower roller 33 is cleaned (the foreign matter D is removed). As shown in FIG. 8, the foreign matter D adhered on the conveyance face 34 of the lower roller 33 is blocked at a contact start point CP between the web W and the lower roller 33 (a portion where the web W and the lower roller 33 begin to come into contact with each other), and then is scraped from the conveyance face 34. The foreign matter D accumulates on the upstream end of the contact face CF between the web W and the lower roller 33 (near the contact start point CP) in the rotational direction of the lower roller 33 (the counterclockwise direction). During the cleaning of the lower roller 33, exciting current is continuously supplied to the cleaning motor 94 from the controller 28. This prevents the rocking arms 92 from being turned downward, and the cleaning unit 61 is kept in the cleaning position P1.

<Separation of cleaning unit, winding of web> After the cleaning of the lower roller 33 is completed, the driving of the resist motor 35 is stopped according to a driving stop command output from the controller 28, and the rotation of the resist rollers 32 and 33 is stopped. As shown in FIG. 7, when the cleaning motor 94 is driven according to a cleaning completion command output from the controller 28, the rocking arm 92 is turned downward. The cleaning unit 61 begins to be displaced from the cleaning position P1 to the separation position P2, and the guide roller 78 begins to roll along the guide face 116 downward.

Because the guide face 116 curves from the lower roller 33 in the left lower direction, the cleaning unit 61 is displaced downward along an approximately circular path. That is, the unit moving mechanism 62 displaces the cleaning unit 61 disposed in the cleaning position P1 to the separation position P2 while rotating it in the same direction as the rotational direction of the lower roller 33 (refer to the thick line arrow in FIG. 9). Focusing on the contact face CF between the lower roller 33 and the web W, when the unit moving mechanism 62 displaces the cleaning unit 61 from the cleaning position P1 to the separation position P2, the unit moving mechanism 62 displaces the cleaning unit 61 in a counter direction (refer to the one-dotted chain line arrow in FIG. 8 and FIG. 9) which is an opposite direction to the rotational direction of the lower roller 33 on the contact face CF. Specifically, the web W wound around the pressure roller 67 begins to be displaced almost leftward while coming into contact with the conveyance face 34 of the lower roller 33, and is gradually separated away as displaced leftward.

The above is expressed as follows from another viewpoint. When the lower roller 33 is rotated in the cleaning position P1, a position where the web W and the lower roller 33 first come into contact with each other is set to the contact start point. The contact start point is an end of the contact face CF. In FIG. 8, the contact start point is the left end of the contact face CF. A rotational direction of the lower roller 33 on the contact start point is set to a tangential direction. In FIG. 8, the tangential direction is almost the right direction. In a sectional view, a direction crossing to the tangential line at right angles and separating away from the lower roller 33 is set to a normal direction. In FIG. 8, the normal direction is almost the lower direction. When the cleaning unit 61 begins to be displaced from the cleaning position P1 to the separation position P2, the web W positioned on the contact start point moves to an area between the tangential direction and the normal direction.

As shown in FIG. 9, the web W wound around the pressure roller 67 is moved while sliding on the conveyance face 34 of the lower roller 33, and is thus separated away downward while scraping the foreign matter D accumulated near the contact start point CP. Then, in a state where the cleaning unit 61 is displaced to the separation position P2, the winding roller 68 is driven by the web driving mechanism 63 to wind the used portion of the web W (refer to the broken line arrow in FIG. 9).

Specifically, when the web solenoid 101 is driven according to a driving command output from the controller 28, the plunger 102 is protruded and retraced (reciprocated) relative to the case 101A (refer to FIG. 5). When the plunger 102 is protruded, the turning lever 103 is idled relative to the turning shaft 104 in the counterclockwise direction by the function of the one-way clutch 110 (the turning shaft 104 is not turned). On the other hand, when the plunger 102 is retracted, the turning lever 103 is turned together with the turning shaft 104 in the clockwise direction via the one-way clutch 110. The output gear 113 fixed to the turning shaft 104 is rotated together, and the rotational force of the output gear 113 is transmitted to the input gear 79 of the cleaning unit 61 (the winding roller 68) via the transmission gears 111 and 112. Then, the winding roller 68 is rotated in the counterclockwise direction, and the web W is wound around the winding roller 68 while delivered from the web roll WR of the delivery roller 66. In the above manner, the rotation transmission mechanism 108 transmits the rotational force to the winding roller 68 only when the turning lever 103 is turned in one direction.

As described above, the web driving mechanism 63 uses the stroke (the reciprocating movement) of the plunger 102 of the web solenoid 101 to wind the used web W and then to deliver the unused web W from the web roll WR. Then, at the next cleaning operation, it becomes possible to bring the unused portion of the web W into pressure-contact with the conveyance face 34 of the lower roller 33.

In the web driving mechanism 63, the third sensor 109 detects the detection piece 107 every time when the turning lever 103 is turned (reciprocates) (every time when the plunger 102 is protruded and retracted). The controller 28 previously stores a web winding amount per unit when the plunger 102 of the web solenoid 101 is protruded and retracted one time (one reciprocating movement), and calculates a remaining amount of the web W wound around the delivery roller 66 based on a detection number of the third sensor 109 (a number of the protruding and retracting of the plunger 102) and the web winding amount per unit. When the remaining amount of the web W is less than a predetermined amount, the controller 28 displays a massage for replacement of the cleaning unit 61 on the touch panel of the image forming apparatus 1.

The cleaning device 60 according to the embodiment described above is configured such that the cleaning unit 61 is displaced in an opposite direction to the rotational direction of the lower roller 33 on the contact face CF and then disposed in the separation position P2. That is, on a middle of the displacement of the cleaning unit 61 from the cleaning position P1 to the separation position P2, the web W is moved while sliding on the conveyance face 34 of the lower roller 33 in the counter direction. According to the configuration, it becomes possible to scrape the foreign matter D accumulated at the contact start point CP between the lower roller 33 and the web W by the web W moving in the counter direction. Thereby, in a state where the cleaning unit 61 is separated away from the lower roller 33 after the cleaning operation, it becomes possible to decrease an amount of the foreign matter D remaining on the lower roller 33. As a result, it becomes possible to inhibit the image contamination caused by the foreign matter D remaining on the lower roller 33.

According to the cleaning device 60 of the embodiment, because the cleaning unit 61 is displaced from the cleaning position P1 to the separation position P2 along almost a circular path, it becomes possible to decrease the pressing force of the web W (the pressure roller 67) on the lower roller 33 gradually. Thereby, it becomes possible to achieve both a suitable scraping of the accumulated foreign matter D and a smooth displacement of the cleaning unit 61.

According to the cleaning device 60 of the embodiment, the used portion of the web W is separated away from the lower roller 33, and then collected together with the foreign matter D. Thereby, when the cleaning unit 61 is displaced to the cleaning position P1 next time, it becomes possible to bring the unused portion of the web W into contact with the lower roller 33.

[Modified example] Next, a modified example of the cleaning device 60 (the image forming apparatus 1) according to the present embodiment will be described. In the following description, the same or corresponding structures as the cleaning device 60 according to the above embodiment are marked with the same reference numbers as the above embodiment, and the same or corresponding explanation as the cleaning device 60 (the image forming apparatus 1) is omitted.

Figure 10:
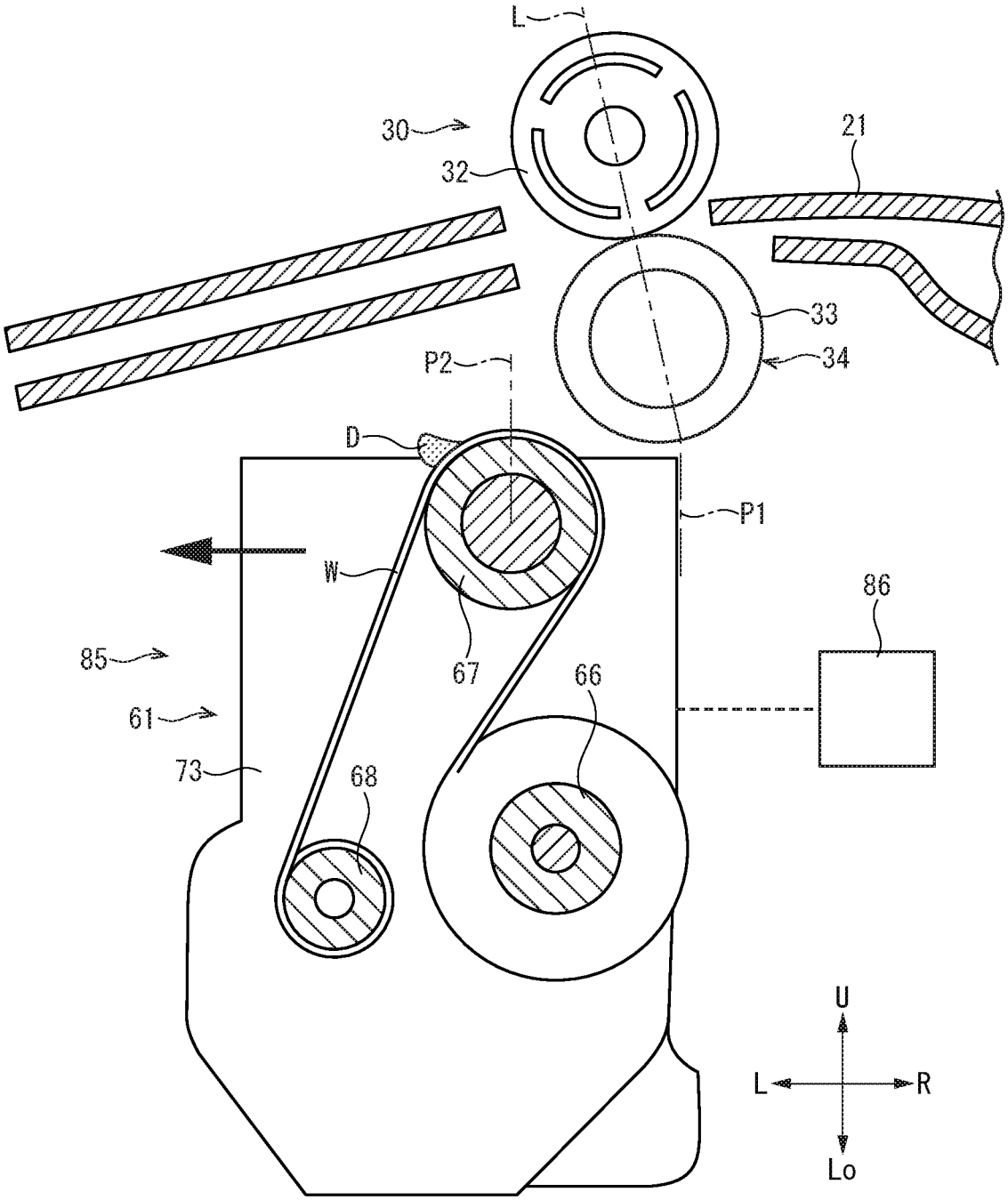
FIG. 10 is a sectional view explaining a separation operation of the cleaning unit of the cleaning device according to a first modified example of the embodiment of the present disclosure.

<First modified example> In the cleaning device 60 in the above described embodiment, when the cleaning unit 61 is displaced from the cleaning position P1 to the separation position P2, the unit moving mechanism 62 turns the cleaning unit 61 in the counter direction on the contact face CF. However, the present disclosure is not limited to the above configuration. For example, as shown in FIG. 10, in a cleaning device 85 according to the first modified example, a unit moving mechanism 86 may displace the cleaning unit 61 disposed in the cleaning position P1 to the separation position P2 set on a downstream side of the lower roller 33 along the first conveyance path 21. That is, the unit moving mechanism 86 may displace the cleaning unit 61 in the left-and-right direction. For example, the unit moving mechanism 86 includes a guide part extending in the left-and-right direction, and turns the turning arm around the support shaft to reciprocate the cleaning unit along the guide part (the example is not shown). According to the cleaning device 85 of the first modified example, the same function and effect as the cleaning device 60 described above can be obtained, for example, it becomes possible to scrape the foreign matter D by the web W moving in the counter direction.

<Second modified example> In the image forming apparatus 1 of the present embodiment (containing the first modified example), the lower roller 33 is stopped before the unit moving mechanisms 62 and 86 displace the cleaning unit 61 from the cleaning position P1 to the separation position P2. However, the present disclosure is not limited to the above configuration. The controller 28 may execute a control to displace the cleaning unit 61 from the cleaning position P1 to the separation position P2 by the unit moving mechanisms 62 and 86 while keeping the rotating of the lower roller 33 accompanied with the cleaning operation. That is, while the lower roller 33 is rotating, the unit moving mechanism 62 may displace the cleaning unit 61 from the cleaning position P1 to the separation position P2. According to the configuration, it becomes possible to press the foreign matter D accumulated at the contact start point CP on the web W moving in the counter direction by the rotating of the lower roller 33. Thereby, compared with a case where the lower roller 33 is stopped and the cleaning unit 61 is displaced in the counter direction, it becomes possible to improve an effect that the web B scrapes the foreign matter D. As a result, it becomes possible to remarkably decrease an amount of the foreign matter D remaining on the lower roller 33 after the cleaning operation.

Figure 11:
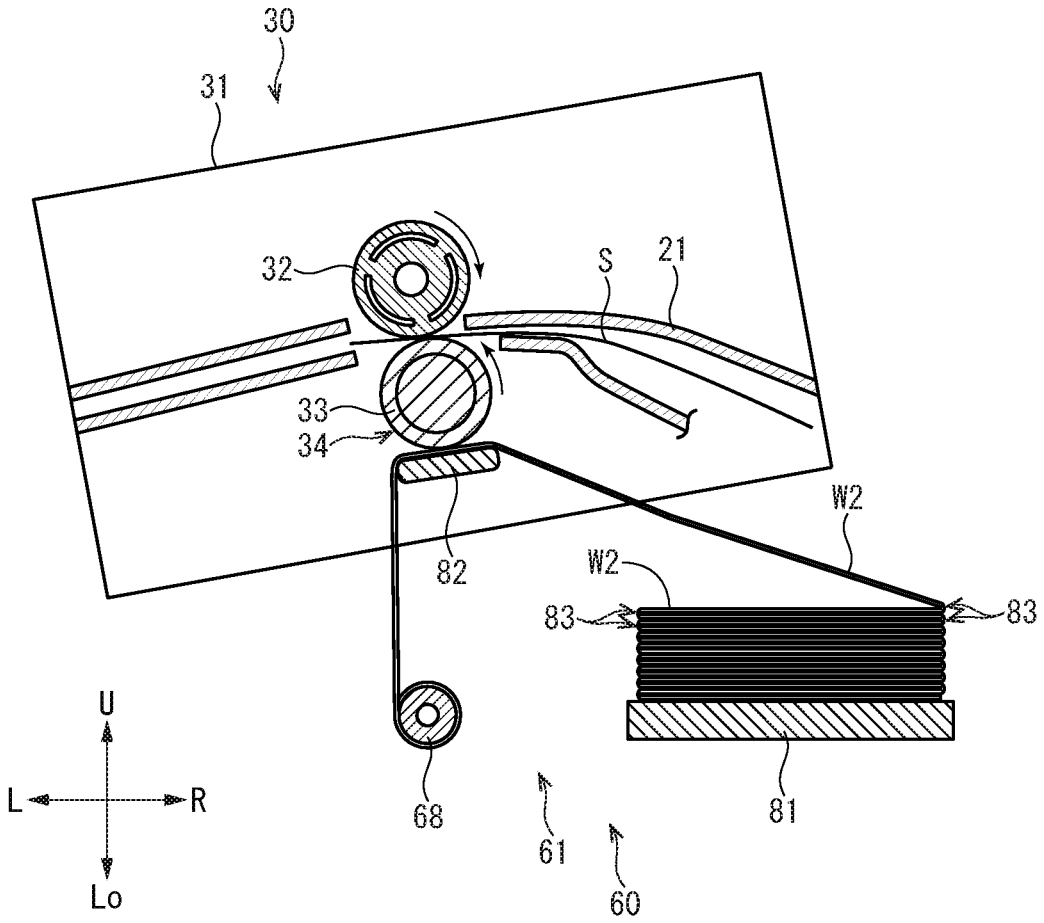
FIG. 11 is a sectional view showing the cleaning device according to a third modified example of the embodiment of the present disclosure.

<Third modified example> The image forming apparatus 1 of the present embodiment (containing the first and second modified examples) is configured such that the belt-shaped web W is wound around the delivery roller 66. However, the present disclosure is not limited to the above configuration. For example, as shown in FIG. 11, as the third modified example, rectangular sheet-shaped webs W2 may be coupled each other via folding lines 83 and folded back alternately along the folding lines 83 into layers. In this case, in place of the delivery roller 66, a table-shaped delivery part 81 is provided, on which the layered web W2 may be placed. Additionally, as shown in FIG. 11, in the same manner, in place of the pressure roller 67, a table-shaped pressing part 82 may be provided, and the web W2 (or the web W) may be moved while sliding on the pressing part 82. It may be possible to select the delivery roller 66, the delivery part 81, the pressure roller 67 and the pressing part 82 suitably and then to combine them.

In the cleaning devices 60 and 85 of the present embodiment (containing the first to the third modified examples, the same shall apply hereinafter), the unit moving mechanisms 62 and 86 are formed by the rocking arm 92 turned around the support shaft 91 and the others, but the present disclosure is not limited to thereto. For example, the unit moving mechanisms 62 and 86 may use a solenoid and a rack and pinion (not shown) to reciprocate the cleaning unit 61 between the cleaning position P1 and the separation position P2. The unit moving mechanism 62 displaces the cleaning unit 61 along the curved guide part 115, but the present disclosure is not limited thereto. For example, the cleaning unit 61 may be supported by the cleaning frame 71 via a turning shaft (not shown) and be turned around the turning shaft (this example is not shown).

In the cleaning devices 60 and 85 of the present embodiment, the winding operation of the web W is performed in a state where the cleaning unit 61 is displaced in the separation position P2, but the present disclosure is not limited to thereto. For example, when the cleaning operation of the lower roller 33 is performed continuously, the winding operation of the web W may be performed in a state where the cleaning unit 61 is displaced in the cleaning position P2.

In the cleaning devices 60 and 85 of the present embodiment, the web W is wound by using the stroke of the plunger 102 of the web solenoid 101, but the present disclosure is not limited to thereto. For example, in place of the web solenoid 101, a stepping motor (not shown) capable of controlling a rotational angle may rotate the winding roller 68.

In the cleaning devices 60 and 85 (the cleaning unit 61) of the present embodiment, the pressure roller 67 and the pressing part 82 bring the web W and W2 into pressure-contact with the lower roller 33, but the present disclosure is not limited to thereto. For example, the pressure roller 67 and the pressing part 82 may not be provided, and the webs W and W2 disposed between the delivery roller 66 (the delivery part 81) and the winding roller 68 in tension may be brought into pressure-contact with the lower roller 33 (the example is not shown).

In the cleaning devices 60 and 85 of the present embodiment, the unit moving mechanisms 62 and 86 displace the cleaning unit 61 to the cleaning position P1, to the separation position P2 and to the attachment and detachment position P3, but the present disclosure is not limited thereto. The unit moving mechanism only needs to displace the cleaning unit 61 between the cleaning position P1 and the separation position P2.

The present embodiment shows the sheet powder and the ink (the pigment) as an example of the foreign matter, and the foreign matter is not limited thereto. For example, the foreign matter D may contain dust generated in the housing 10.

The cleaning devices 60 and 85 of the present embodiment have a configuration for cleaning the lower roller 33, but the present disclosure it not limited to the configuration.

The cleaning devices 60 and 85 may clean the conveyance member conveying the sheet S, other than the lower roller 33.

The image forming apparatus 1 according to the present embodiment is the inkjet type printer, but may be an electrophotographic type image forming apparatus (a copying machine, a facsimile, and the others). In this case, a toner and the others correspond to the foreign matter D. The sheet S is not limited to the paper sheet, but may be a resin sheet.

The above embodiment has been described with respect to specific embodiments in the cleaning device and the image forming apparatus according to the present disclosure, and the technical scope of the present disclosure is not limited to the above embodiment.

The invention claimed is:

1. A cleaning device comprising:

a cleaning unit which brings a web into contact with a conveyance member rotating around an axis and removes foreign matter adhered to the conveyance member; and a unit moving mechanism which displaces the cleaning unit to a cleaning position where the web is brought into contact with the conveyance member and to a separation position where the web is separated away from the conveyance member, wherein when the unit moving mechanism displaces the cleaning unit from the cleaning position to the separation position, the cleaning unit is displaced in a counter direction opposite to a rotational direction of the conveyance member on a contact face between the conveyance member and the web, wherein the unit moving mechanism includes:

a support shaft supported in a rotatable manner, and a rocking arm fixed to the support shaft, wherein the cleaning unit is supported by the rocking arm in a relatively rotatable manner around a pin as a rotating shaft disposed in a position different from the support shaft, and when the rocking arm is turned around the support shaft, the unit moving mechanism turns the cleaning unit.

2. An image forming apparatus comprising the cleaning device according to claim 1, wherein the conveyance member conveys a sheet along a conveyance path while rotating around an axis.

3. The image forming apparatus according to claim 2, wherein the unit moving mechanism displaces the cleaning unit from the cleaning position to the separation position while the conveyance member is rotating.

4. The cleaning device according to claim 1, wherein when a rotational direction of the conveyance member on a contact start point where the web is first brought into contact with the conveyance member when the conveyance member is rotated in the cleaning position is set to a tangential direction and a direction crossing to the tangential direction at right angles and separated away from the conveyance member is set to a normal direction, the unit moving mechanism displaces the cleaning unit from the cleaning position to the separation position such that the web positioned on the contact start point moves to an area between the tangential direction and the normal direction.

5. The cleaning device according to claim 1, wherein the conveyance member conveys a sheet as a recording medium, and the unit moving mechanism displaces the cleaning unit disposed in the cleaning position to the separation position set on a downstream side of the conveyance member in a conveyance direction of the sheet conveyed along a conveyance path by the conveyance member.

6. The cleaning device according to claim 1, wherein the cleaning unit includes:

a delivery part delivering the web wound in a roll;

a pressing part bringing a part of the web delivered from the delivery part into pressure-contact with the conveyance member in the cleaning position; and a winding part winding a used portion of the web after the web is brought into contact with the conveyance member, wherein the winding part winds the used portion of the web in a state where the cleaning unit is displaced to the separation position.

7. The cleaning device according to claim 1, wherein the unit moving mechanism displaces the cleaning unit from the cleaning position to the separation position while sliding the web along a conveyance face of the conveyance member.

8. The cleaning device according to claim 1, wherein the cleaning unit includes:

a delivery part on which the web folded back along folding lines alternately into multiple layers is placed;

a pressing part bringing a part of the web delivered from the delivery part into pressure-contact with the conveyance member; and a winding part winding a used portion of the web after the web is brought into contact with the conveyance member, wherein the winding part winds the used portion of the web in a state where the cleaning unit is displaced to the separation position.

9. The cleaning device according to claim 1, wherein when the unit moving mechanism displaces the cleaning unit from the cleaning position to the separation position, the unit moving mechanism turns the cleaning unit in the same direction as the rotational direction of the conveyance member such that the web is moved in the counter direction while sliding on a conveyance face of the conveyance member.

* * * * *